United States Patent [19]

Van Horn

[11] Patent Number: 4,872,963

[45] Date of Patent: Oct. 10, 1989

[54] METHOD AND APPARATUS FOR IMPROVED ELECTROPLATING AND PAINTING RACKS

[76] Inventor: Samuel L. Van Horn, 2270 S. High St., Columbus, Ohio 43207

[21] Appl. No.: 193,560

[22] Filed: May 13, 1988

Related U.S. Application Data

[63] Continuation-in-part of Ser. No. 656,253, Oct. 1, 1984, Pat. No. 4,591,420, Continuation-in-part of Ser. No. 828,030, Feb. 10, 1986, abandoned.

[51] Int. Cl.[4] ..... C25D 17/08; B05C 13/00

[52] U.S. Cl. ..... 204/297 W; 204/297 R; 204/285; 204/288; 118/500; 118/503

[58] Field of Search ..... 204/297 R, 297 W, 285, 204/286, 288; 118/500, 503

[56] References Cited

U.S. PATENT DOCUMENTS

| | | | |
|---|---|---|---|
| 1,750,807 | 3/1930 | Lichtman | 204/297 W |
| 2,364,822 | 12/1944 | Schneider | 204/297 W |
| 3,642,147 | 2/1972 | Voorhies | 211/181 |

FOREIGN PATENT DOCUMENTS

| | | | |
|---|---|---|---|
| 773799 | 6/1955 | United Kingdom | 204/297 |

OTHER PUBLICATIONS

J. John Preston "Plating Jigs" Metal Industry, 11, Mar. 55, pp. 189–191.

*Primary Examiner*—John F. Niebling
*Assistant Examiner*—John S. Starsiak, Jr.
*Attorney, Agent, or Firm*—John L. Shailer

[57] ABSTRACT

A retaining tip for releasable attachment to a rod having a cross-section in which two arms are attached to one another at one end of each by a circular wound helical spring. The other end of each arm is configured to retain parts or objects which are to be processed. The circular spring may be mechanically opened to receive the circular rod and then released to frictionally engage the rod. Clips utilizing a similar design are used to join cross members to build up an electroplating or painting fixture. An alternative support rack is constructed by means of releasable attachment of side bar members to cross bars.

9 Claims, 4 Drawing Sheets

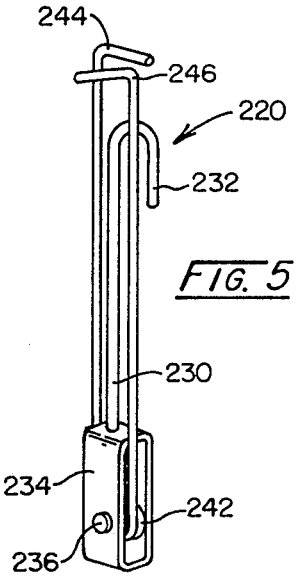
FIG. 5
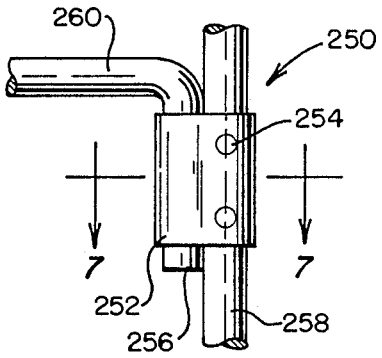
FIG. 6
FIG. 7
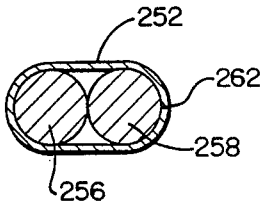
FIG. 8
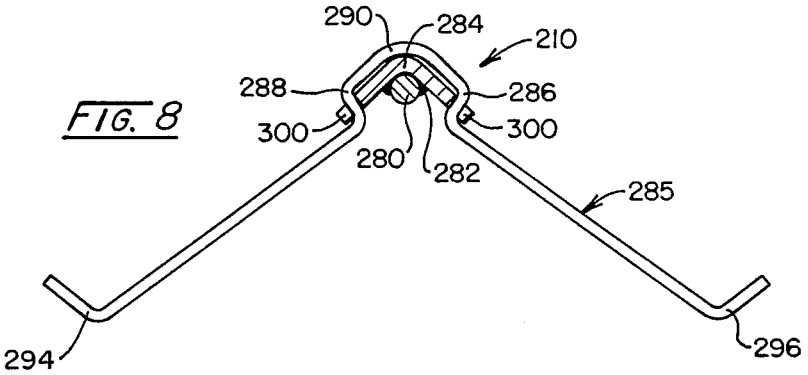

METHOD AND APPARATUS FOR IMPROVED ELECTROPLATING AND PAINTING RACKS

FIELD OF THE INVENTION

The present application is a continuation-in-part of copending U.S. patent application Ser. No. 656,253, filed on Oct. 1, 1984, now U.S. Pat. No. 4,591,420 issued May 27, 1986, and U.S. patent application No. 828,030, filed on Feb. 10, 1986, now abandoned, which is copending and both of which are incorporated herein by reference thereto.

The invention relates to an improved method for constructing racks for supporting objects during processing and to the specific apparatus of the improved racks.

BACKGROUND OF THE INVENTION

Fixtures of the type used, for example, in the fields of painting and electroplating represent a major investment for businesses that engage in the painting or electroplating of objects. It has heretofor been necessary to fabricate the fixtures or racks, as they are called in the art, to meet the precise physical support requirements of the objects or parts to be processed. This "specialization" of rack design is especially cumbersome to the custom paint or electroplating shop of the type which accepts job contracts. Such a shop or business must of necessity not only maintain an extensive inventory of special and general purpose racks, but still must maintain the means, either by in-house fabrication facilities or by purchase, to obtain additional specialty racks or fixtures.

Fixtures heretofore used in electroplating and painting have also had the problem of being inefficiently constructed. The inefficiencies lie in two distinct areas. First there is the inefficiency of welded, brazed or mechanically fastened means for holding the part supporting members to a main conducting bar which is usually made from copper. In a typical construction found in the prior art, copper bars of approximately one-half inch square cross-section (12.5 mm by 12.5 mm) are joined at right angles in a cross shape by drilling and tapping the bars and through bolting at the intersection. The process of drilling and tapping removes a portion of the electrical conduction path of the copper bars causing inefficiencies and non-uniform electrical current distribution in the bars. This also results in less current being transmitted to the parts held in the fixture. Object/part holders, or tips as they are called in the art, are attached to the conducting bars in a similar fashion.

Second is the inefficiency of construction. The labor intensive steps of drilling, tapping or even of brazing the bar intersection joints and tips into the fabricated rack or fixture considerably add to the cost of the final fixture and to the costs which must be charged by the business. Even minor modification of the rack to suit new purposes can be an involved and labor intensive process. Additionally, inventoried racks represent a large amount of copper which is not being efficiently utilized, but which has heretofor been stored with the inventoried racks.

An additional problem encountered on fixtures or racks which are used to position, support or retain objects to be electroplated or especially painted, is that materials of the process (i.e., paint or coating materials) build-up on the fixture and can drip, under the action of gravity, on the objects being processed.

Therefore, there is a need for a method of constructing fixtures or racks in which the bars and tips from which the racks are constructed may be easily connected and disconnected from one another. There is also a need for an apparatus for attaching bars and tips to one another such that both the bars and the tips can be reused. There is also a need for a method and apparatus for constructing electroplating racks in which the conducting bars and tips may be joined together without the removal of, interference with or reduction of the electrical path, while maintaining good electrical contact between the respective bars and tips.

There is also a need for a utility type of bar from which objects to be painted or electroplated may be suspended which protects the objects from dripping paint or materials which build-up on the fixture or rack.

There is additionally, a need for easily constructed, easily stored and reusable painting racks and fixtures for reasons similar to those stated above, since the problems of the electroplating industry are shared by the painting industry, whether electrostatically charged painting systems are utilized or not.

Further, there is a need for painting and/or electroplating racks and fixtures which are easily assembled yet can be broken down into unit construction pieces for easy, low volume, shipping from fabricator to user.

Electroplating racks additionally are subject to being themselves plated. This problem has been solved in the prior art by covering the completely fabricated rack with a plastic or similar coating which is impervious to the electroplating bath and is electrically non-conductive, Unfortunately, the solution of the electroplating bath is often partially lost by being siphoned between the rack and its protective coating by a strong capillary action. This also leads to destruction of the rack as the solution is passed directly over the metal surfaces.

Therefore, there is a need for an apparatus and method for, preventing the initiation of such siphoning by capillary action.

SUMMARY OF THE INVENTION

A primary aspect of the present invention lies in the provision of a retaining tip made of a spring material. The tip has two arms which are joined to one another at one end by a circular wound helical spring of at least 180 degrees, the diameter of the circular winding being small relative to the length of the arms.

Another aspect of the present invention provides a method of utilizing the above described retaining tip in the construction of a rack by placing the circular winding of the circular wound spring around a circular cross-sectioned bar so that the two are in tight contact.

An additional aspect of the present invention resides in the provision of a bar or rod around which a circular wound helical spring bearing retaining tip is placed, in which the bar or rod has essentially any cross-sectional shape including circular, square, triangular hexagonal or rectangular, the inside diameter of the said circular wound helical spring corresponding to the diameter of the bar or rod.

A further aspect of the present invention resides in the provision of object supporting end shapes to the arms of the above described retaining tip, the ends opposite or distal from those at which the arms are joined at the spring. The object supporting ends are configured to the parts or objects to be supported or retained.

Another aspect of the present invention lies in the provision of retaining tips which are easily and quickly removed from the circular cross-sectioned bars of a basic rack or fixture so that different tips may be located at random desired locations on the basic rack.

A further aspect of the present invention resides in the provision of a protective coating on a rack or fixture tightly retained by a compressed wire for the prevention of establishing capillary flow of electroplating bath solution between the coating and the rack structure.

Another aspect of the present invention lies in the provision of a releasably lockable apparatus for joining two bar members. The apparatus has two arm members which are joined one to the other at one end of each by a circular wound helical spring of at least 180 degrees. The arms are curved or bent in a way to return them to the axis of the helix of the spring. The other ends of the arms, distal from the spring end are configured to releasably and lockably engage one another.

A further aspect of the present invention resides in the provision of a removeable electrically conductive shape which is the means for electrically connecting the electroplating rack to a D.C. power source.

Another primary aspect of the present invention resides in the provision of releasable attachment of the cross-bar members and side rod members which constitute the frame of a support rack so that the members may be shipped disassembled for later assembly and for flexibility in the configuration of the assembled rack.

A further aspect of the present invention resides in a releasable attachment method by which cross-bar members are configured to utilize sockets attached to the side rod members of a support rack.

An additional primary aspect of the present invention resides in disposing a support plate over the cross-bar/-cross-support members of the fixture to deflect the path of materials dripping from the fixture away from the objects being processed.

Another aspect of the present invention resides in the provision of a retaining clip for use with the support plate for closely and efficiently spacing objects to be processed.

A further aspect of the present invention resides in the provision of retaining clips configured to releasably engage a support plate which is disposed over the cross-support members. This retaining clip utilizes two opposed angular shapes to engage the edges of the support plate. The wire material of the retaining clip between the two angular shapes may be further utilized to engage the surface of the support plate, especially when the support plate has been configured as an angle shape, the angle being considered a part of the original surface of the support plate.

BRIEF DESCRIPTION OF THE DRAWINGS

The best mode contemplated in carrying out this invention is illustrated and better understood by reference to the following detailed description when considered in conjunction with the accompanying drawings and in which:

FIG. 5 is a perspective view of the hanger assembly of FIG. 4 in a storage condition according to the present invention.

FIG. 6 is a detail of the releasable means for connecting a cross support member to a primary support member according to the present invention.

FIG. 7 is a sectional view of the releasable means of FIG. 6 taken along line 7—7.

FIG. 8 is a sectional view of the utility cross support member and support plate showing a retaining clip in position on the support plate according to the present invention.

DESCRIPTION OF THE PREFERRED EMBODIMENT

Figure 2:
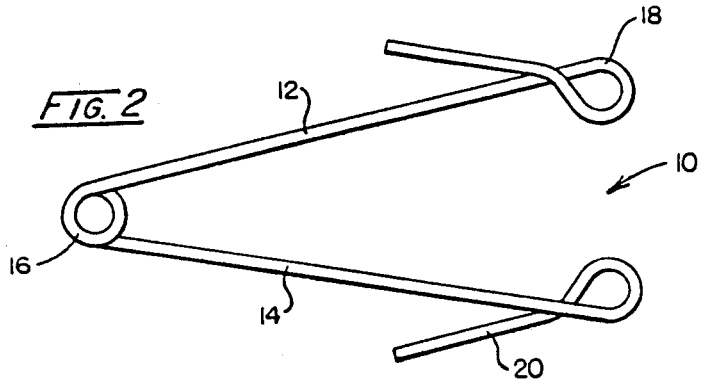
FIG. 2 is a plan view of a retaining tip according to the present invention.

With reference to the drawings, FIG. 2 describes a retaining tip generally shown 10, according to the present invention. An arm 12 is joined to a second arm 14 at one end of each arm by a circular wound helical spring 16. Additionally, each arm 12 and 14 terminates at its other or distal end in an object holding shape 18 and 20. The apparatus 10 is preferrably fabricated from a single piece of spring wire by forming the circular wound helical spring 16 at substantially the center of a wire piece. The diameter of the spring winding 16 is small compared to the length of the wire piece. The spring winding must be greater than 180 degrees ($\pi$ radians) since spring is sized to receive a rod by fully surrounding the rod with the spring, as is more fully described below. It is preferrably that the spring be formed to be a helix of at least 450 degrees (5/2 $\pi$ radians) but less than 540 degrees (3 $\pi$ radians), and with additional windings of 360 degrees (2 $\pi$ radians) as is necessary to obtain the requisite gripping strength of the spring winding to a rod, as is more fully described below.

The wire from which retaining tip 10 according to the present invention is preferred to be fabricated varies according to the use to which the retaining tip is to put. In the case of electroplating processes, the tip would retain a part or parts to be electroplated in an electroplating bath or solution of the types known to those familiar with the art. A retaining tip for use in electroplating processes should be fabricated from type 302, type 304 or type 316 stainless steels or at least from one of the austenitic stainless steels. Steels having a high carbon content will tend to be subject to hydrogen embrittlement under the conditions of an electroplating conditions and these alloys are to be avoided. However, if the retaining tip is to be utilized in a parts painting fixture or rack, a mild carbon steel having spring properties is acceptable, as for example mild spring steel. It is not a requirement that the wire, from which a retaining tip according to the present invention is fabricated, be of any particular gauge or diameter. The requirement is that the fabricated retaining tip be capable of supporting the object or part for which it has been designed. Typical wire sizes range in diameter from 0.032 inch to 3/16 inch (0.8 mm to 4.8 mm), but greater or smaller diameters may be utilized in the practice of the present invention.

Figure 1:
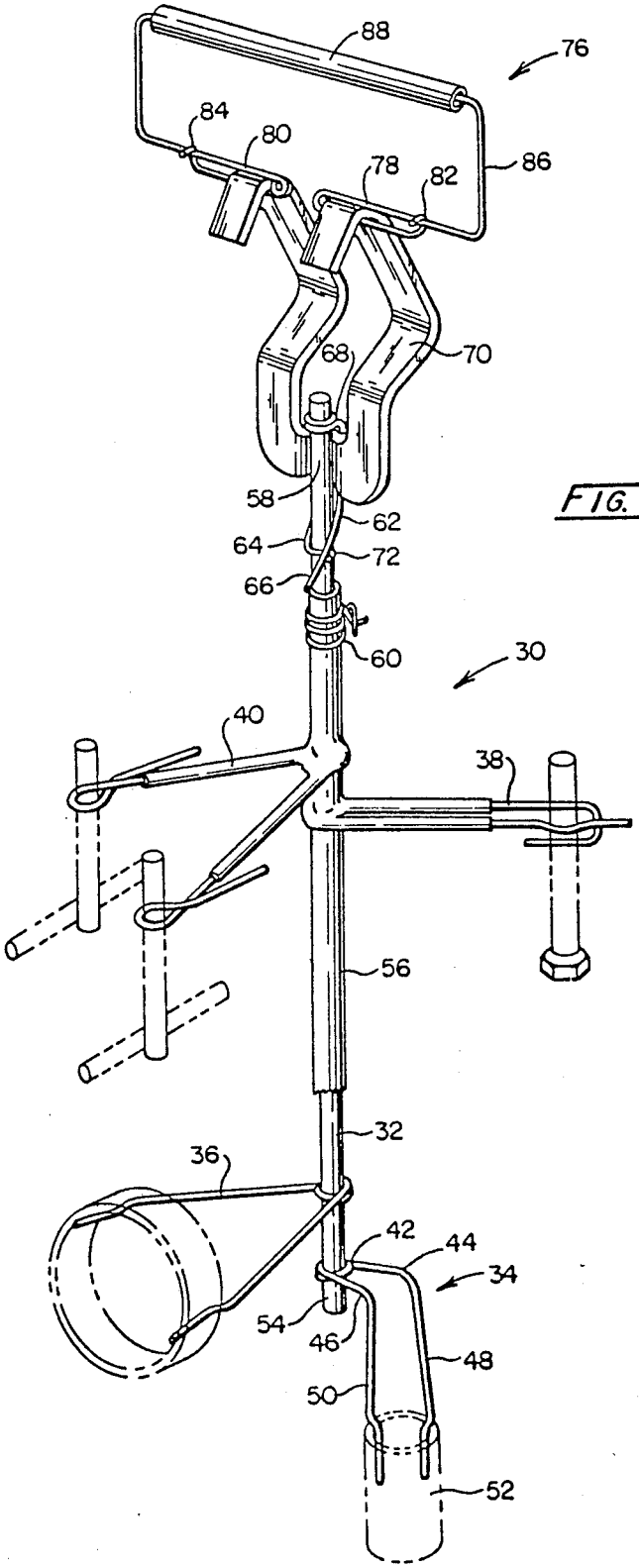
FIG. 1 is a perspective view of an electroplating fixture according to the present invention, in partial cut-away.

With reference to drawing FIG. 1, a fixture 30 according to the present invention is depicted in partial cut-away. Fixture 30 is also uniquely configured for use in holding objects or parts during an electroplating process. A central support rod 32 has retaining tips 34,36, 38 and 40 according to the present invention attached to it Retaining tips 34,36,38 and 40 are substantially similar to retaining tip 10 (FIG. 2) described above, differing primarily in the shape of the object or part holding shape residing at the ends of the arms distal from the circular wound spring. The object holding shape is configured to retain a part for which the tip is designed.

Clearly depicted in FIG. 1 is the means for securing the retaining tip 34 to the central rod 32. It will be understood that all of the retaining tips are attached by the process hereafter described. The circular wound helical spring 42 joins the two arms 44 and 46 which have also been bent, the object retaining shapes 48,50 beginning at the bend in the arms and continuing to the end of the arms distal from the spring. An object 52 is shown in dotted line to depict the means of object retention. The object retaining shapes vary according to the requirements of the object to be retained and supported by the retaining tip.

Circular wound spring 42 surrounds central rod 32 when it has been properly located as described below. The diameter of circular wound spring 42 when the spring is at rest is less than but substantially the same as that of the rod 32, so that when in place on rod 32, spring 42 firmly grasps rod 32. Spring 42 is placed over rod 32 by "opening" the spring, by which is meant that arms 44 and 46 are grasped and separated such that the circular wound helical spring 42 is slightly unwound by a few degrees thus increasing the diameter of the circular wound spring. The increased diameter circular winding is then placed over the end 54 of central rod 32 and moved the desired distance along central rod 32. Once the proper or desired location on rod 32 has been reached, the arms 44 and 46 are released thus allowing the circular winding to partially relax and firmly grasp the surface of central rod 32. The spring winding is not fully relaxed to its rest position, thereby allowing a residual of grasping force by which the spring engages the rod surface. In this way, tips may be placed and easily moved along the central rod 32 to achieve optimal results from the fabricated fixture without removal of any metal or the use of drill and tap connections. In the preferred embodiment, the gripping power of the partially relaxed circular winding around the central rod is sufficient to prevent the retaining tip from even rotating about the axis of the central rod. This is achieved by correlating the at rest diameter of the circular would spring to the diameter of the rod.

In an electroplating fixture, the tightness of the grip of the circular winding of a retaining tip according to the present invention against the central rod is critical so that proper electrical conduction can be obtained. It will also be recognized that a central rod may also be a series of cross members in a "tree" shape to economize space and to provide other locations for tips on the rod members.

It will be appreciated that a circular cross-sectioned rod will provide greater electrical connection to a helical wound spring than will other shapes in which only points of contact are achieved. However, electrical connection is achieved with all shapes when contact is made between the helical spring and the shaped rod. Additionally, it will be recognized that gripping strength is, in part, a function of the number of points of contact between the inside of the helical wound spring and the rod upon which it is disposed, as well as the spring parameters of the helical wound spring itself.

The frictional gripping strength of the circular wound helical spring of a retaining tip to the rod or bar, regardless of cross-sectional configuration, of the rod or bar, is a carefully monitored and planned part of the fabrication and design of such a connection. In electroplating, it is important that the retaining tip according to the present invention not move relative to the rod, even before the object to be electroplated is placed upon the retaining tip. In the context of the present invention, relative movement of the retaining tip to the rod upon which it is mounted refers to both the axial and radial movement or displacement. Both are undesirable and the gripping strength must be sufficient to prevent both.

Turning again to FIG. 1, the method and apparatus of an improved electroplating or painting rack with the above characteristics can be appreciated and understood further.

Once a central rod has been provided with the required retaining tips, it is usual in the art of electroplating fixture fabrication to provide a protective coating 56 around the metal parts of the fixture. The protective coating is to protect the metal from the corrosive effects of the electroplating bath or solution, but more importantly is to protect the expensive dissolved metal salts of the bath from being plated onto the fixture rather than the objects desire to be plated. Protective coating 56 is preferrably a vinyl, polyethylene or a polyvinylchloride compound material that may be applied by dip coating in molten plastic. The primary characteristics of the coating are non-electrical conducting and chemical resistance. The preferred material may vary depending upon the chemicals present in the electroplating bath. The coating is then cut-away from the metal at the object retaining shapes of the tips and at the end 58 of the central rod at which it is electrically connected to an electrical power source. In this way a path for electrical current from a D.C. power source to the object is established through the fixture. To protect from the loss of electroplating bath or solution by capillary action between the coating 56 and central rod 32 (through the retaining tips), a releasably lockable spring wire 60 is provided around the protective coating 56 at the end of the central rod near the point of connection to the electrical power source. The spring wire 60 is a wire that fully surrounds the protective coating 56 and that is releasably locked by engagement of the wire ends. The wire is tightened in locking so that the wire deforms the protective coating 56 into the surface of central rod 32 thus cutting off any capillary flow of liquids between the coating and the rod it surrounds. In this way no liquid may be lost by this route.

Retaining clamp 62 and retaining clamps 100 and 102 are the same apparatus and are alternative forms of the retaining tip described in FIG. 2 above. In retaining clamp 62, two arm members 64 and 66 have been curved toward and past the axis of the circular winding of spring 68 so as to be able to retain an object between the arms and the rod over which remaining clamp 62 is utilized. In the example shown in FIG. 1, retaining clamp 62 is on central rod 32 to retain conductor hanger 70 between arms 64, 66 and central rod 32, thereby preventing either axial or rotational movement of the conductor hanger relative to the rod. The ends of arms 64 and 66 distal from spring 68 have been further configured to engage each other after passing rod 32 the engagement point 72 is releasably lockable for removal of conductor hanger 70 from central rod 32. The retaining clamps 62 is mounted on central rod 32 in the manner previously described by separating arms 64 and 66.

It should be noted that conductor hanger 70 in an electroplating fixture configuration represents a large amount of the conducting material, usually copper, that is committed to the fixture. By removeably attaching conductor hanger 70 to the balance of the fixture, the conductor hanger may be interchangeably utilized on other fixtures, thereby conserving the amount of copper committed to fixture inventory at an electroplating process and providing the mechanical support for the entire fixture and its contents of arts in the electroplating bath.

Additionally shown in FIG. 1 is a handle 76 which utilizes friction clips 78 and 80 to tightly engage conductor hanger 70. Friction clips 78 and 80 are releasable by disengaging lock points 82 and 84 respectively. By means of the wire shape 86, the assembly acts as a handle for carrying fixtures from place to place in the electroplating facility. A loosely attached sleeve 88 surrounds wire 86. In this way, one holding a fixture by sleeve 88 is prevented from holding the fixture in any way other than the vertical since the sleeve will allow wire 86 to move according to the weight distribution of the rack.

Figure 3:
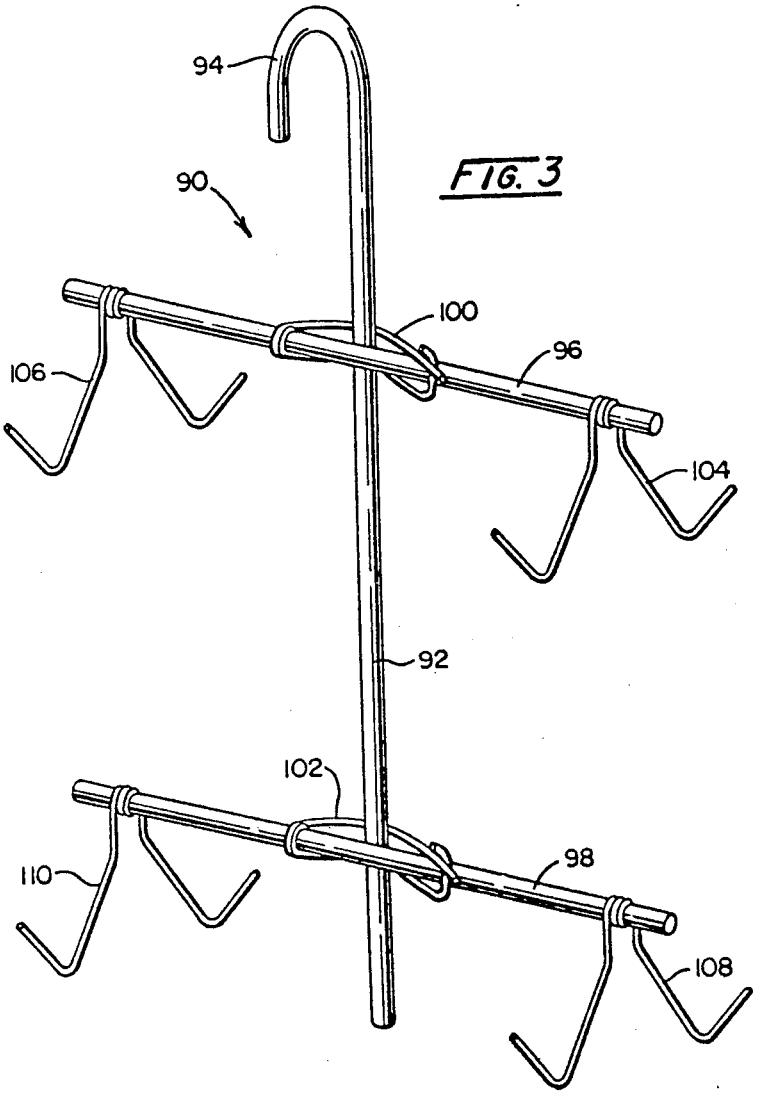
FIG. 3 is a perspective view of an alternative embodiment fixture according to the present invention.

With reference to the drawings, FIG. 3 is an alternative embodiment of a fixture according to the present invention. A fixture 90 such as that shown may be utilized for other purposes than electroplating, as for example in retaining objects to be painted. A central rod 92 has a handle or hanger 94 which is preferably a simple bend in the central rod. It will be appreciated that a handle 94 may take other forms or even be removably attached as in FIG. 1. Cross members 96 and 98 are releasably attached to central rod 92 by locking clips 100 and 102 according to the present invention, respectively. Retaining clamps 100 and 102 are similar in construction to retaining clamp 62 described in FIG. 1 and act to tightly retain the cross members to the central rod. It will be appreciated that the retaining clamps may also be utilized with the circular wound helical spring disposed about the central rod.

Retaining tips 104, 106, 108 and 110 according to the present invention are depicted located on cross members 96 and 98. It will be appreciated that the retaining tips are firmly and tightly grasping the surface of the cross members so that they may be rotated initially to positions other than those shown in FIG. 3 and remain in those rotated positions even with the weight of parts or objects hanging from the object retaining ends of the retaining tips. In this way, the object to be, for example, painted may be fixedly oriented in any desired position relative to the fixture for optimal painting and workplace efficiency.

Alternative Embodiment of Support Rack

Figure 4:
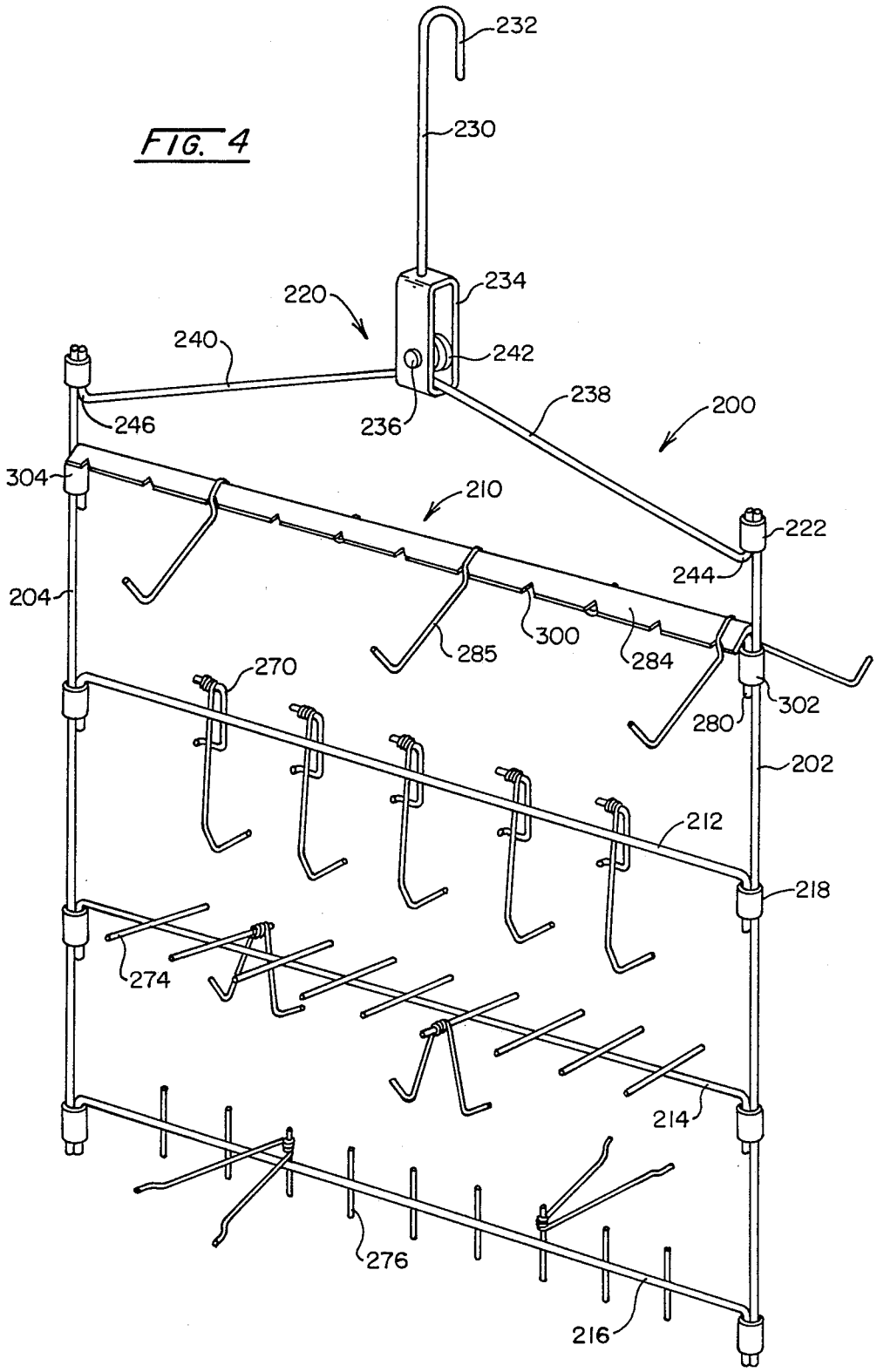
FIG. 4 is a perspective view of an alternative embodiment of a support rack according to the present invention.

Turning now to FIG. 4, an alternative embodiment of a support rack 200 which accords to the present invention the support rack is more clearly understood. Primary support rods 202 and 204 define the sides of the support rack. Utility cross support 210, more fully described below, and cross support rods 212, 214 and 216 are releasably attached to primary support rods 202 and 204 by socket means 218, which is also more fully described below. Additionally, hanger assembly 220 is connected to primary rods 202 and 204 by similar socket means 222.

It will be appreciated that the various elements of support rack 200, namely primary support rods 202 and 204; cross support rods 210, 212, 214 and 216; and hanger assembly 220 may be disassembled and shipped from the site of original fabrication to the paint shop or electroplating facility for easy storage and reassembly. Further, as will be more fully described below, the cross support rods are of varying configuration limited only by the imagination as applied in accordance with the present invention and the resulting support rack may differ by the combination and quantity of cross support rod configurations chosen for use on a given project of painting or electroplating.

To more fully appreciate the aspects of support rack 200 according to the present invention, reference will be made sequentially to the various members or elements of the rack heretofore mentioned.

Turning now to FIG. 5, the hanger assembly is more fully understood. FIG. 5 is a perspective view of the hanger assembly 220 depicted in FIG. 4 in a storage condition according to the present invention. Reference will be made to both FIG. 4 and FIG. 5 in the following description: Hanger assembly 220 utilizes hook number 230 which bears an approximately 180 degree hook shape 232 at one end of a metal rod and bears the housing 234 of a pivotal connection means at the other end. Housing 234 is preferrably a piece of sheetmetal fixedly attached to hook number 230 and which bears bolt means 236 as a place of pivotal connection to arm members 238 and 240. Arm members 238 and 240 are essentially identical. Each is a metal rod approximately ¼ inch in diameter which has been formed into closed loop 242 at one end and bend 244 and 246 configured to utilize socket 222 the releasable attachment method more fully described below. The closed loop is pivotally through—connected over bolting means 236 and can be folded to the storage condition as shown in FIG. 5, around the pivotal connection which is defined by housing 234 and bolt means 236. When un-folded, as shown in FIG. 4, arm members 238 and 240 engage the edge of housing 234 defining the maximum extent to which pivotal motion is permitted. Therefore, the extent of pivotal motion is regulated by the size of housing 234, and the spacing between the engaged surface of housing 234 and the center of rotation of bolt means 236. The diameter of the metal rods from which arm members 238 and 240 are made is also a factor in the regulation of the extent of pivotal motion of the hanger assembly.

It will be appreciated that the hanger assembly, in the storage condition, is easily stored or shipped since it takes up significantly less volume or space than in the unfolded operational condition.

It will be appreciated that the diameter of the metal rods from which the arm and hook members of the hanger assembly are constructed and the sheetmetal gauge of the housing are functions of the planned weight of the finished rack with parts to be processed in place. Since the hanger assembly may be used interchangeably on any number of rack assemblies as previously described, it is preferred that the hanger assembly be designed for the heaviest rack anticipated.

Turning now to the socket connection method for connecting cross support rods 210, 212, 214, or 216 or hanger assembly 220 to primary support rods 202 and/or 204, reference is made to FIGS. 6 and 7. FIG. 6 depicts socket connection 250 which is a novel means for interconnecting the various elements of a support rack. Socket 252, which is preferably a rectangular piece of sheetmetal of relatively thin gauge which has been formed in to an oval sufficient to receive the diameter a primary support rod 258 and the diameter of an approximately 90 degree bend portion 256 in the end of a cross support rod 260. The junction 262 where the socket material ends meet to close the oval shape is preferably located on the circumference of primary support rod 258 at a point distal from the cross support rod 256 point of contact with the primary support rod, all as shown in FIG. 7. Further, socket 252 is located along the length of primary support rod 258 as necessary to space cross-support rods to form a rack like the one in FIG. 4. Once properly located, socket 252 is fixedly attached to primary support rod. The preferred means of attachment is spot welds 254.

It will be appreciated that socket 252 may also be formed around or for use with rods of dissimilar diameter.

The socket connection 250 is then completed by the insertion of 90 degree bend portion 256 of cross support rod 260. The 90 degree bend portion 256 is to have a relatively close tolerance yet not binding fit into socket 252. It is inserted and removed by grasping cross-support rod 260 at a point near socket connection 250 and moving in a direction parallel to primary support rod 258. It will be appreciated that the tolerance of the fit between socket 252 and 90 degree bend portion 256 is lower as the length of socket 252 and the length of 90 degree bend portion 256 increases. It will be appreciated that application of pressure in any direction on a cross-support rod so connected at a place substantially away from socket connection 250 will cause 90 degree bend portion 256 to bind in socket 252 and against the length of primary support rod 258 causing a tight connection. The weight of a cross support rod with or without objects to be processed in place is sufficient to bind the socket connection.

Returning to FIG. 4, cross-support rods 212, 214, and 216 are metal rods which bear at each end a 90 degree bend portion configured to a socket located on primary support rods 202 and 204. In constructing a rack, the cross support rods are interconnected to primary support rods to form a rectangular shaped rack. Disposed along the length of cross support rods 212, 214 and 216 are a plurality of tip holding members 270, 274 or 276. Tip holding members 270, 274 or 276 are made of metal rods of wire shapes configured to receive retaining tips as for example retaining tips 34 and 36 of FIG. 1, or retaining tips 10, 104 or 106 of FIGS. 2 and 3. Tip holding member 274 is fixedly attached to cross support rod 214, and permits the removable retaining tips to be positioned away from the axis of cross support rod 214. In this way, objects held by the retaining tips do not touch the cross support rod. Tip holding member 276 is similar in function to tip holding member 274, but is shown in a different plane relative to its cross support rod. Tip holding member 270 is an example of configuring the tip holding member to receive a specialized retaining tip. The means of attaching those retaining tips to tip holding members 270, 274 or 276 having been previously described.

Turning now to FIG. 8, a novel utility cross support rod 210 according to the present invention may be more fully understood. As has been previously described, utility cross support rod 210 of FIG. 4 and FIG. 8 has use in preventing the dripping of processing materials, as for example paint, from the rack to the objects being processed, painted. Additionally, as will become clear, the retaining clip designed for use on utility rod 210 permits a closer spacing of parts on the rack.

Utility cross support rod 210 has a standard circular cross section metal rod 280 as do most cross support rods according to the present invention, rod 280 is provided with 90 degree bend portions on each end to engage sockets 302 and 304 of FIG. 4. Further, rod 280 has support plate 284 disposed over substantially its entire length between primary support rods 202 and 204. It is preferred that support plate 204 be fixedly attached to rod 280 as by weld bead 282. Further it is preferred that support plate 284 be made of sheetmetal of moderate gauge (i.e., 11 gauge, ⅛ inch or 3.0 mm). It will be appreciated that the actual metal thickness chosen should support the parts being processed with minimal deflection along the length of the utility support rod. Further, it is preferred that support plate 284 be shaped as an angle piece disposed over rod 280 as shown in FIG. 8.

Retaining clip 285 is a piece of wire 290 configured as follows. For a two object supporting retaining clip, two angular shapes 286 and 288, being mirror images of each other and spaced apart along the length of the wire near the middle of wire 290, are configured to the edges of support plate 284. The space between the angular shapes 286 and 288 is dictated by the spatial distance between the edges of angle shape 284 and the shape of wire 290. In FIG. 8, wire 290 is configured to grasp support plate 284 at three points thus defining the plane of retaining clip 285.

It is preferred that angular shapes 286 and 288 are 90 degree bends toward the edge of support plate 284. In the two object supporting shape, wire 290 continues past angular shapes 286 and 288 in reverse bend of approximately 90 degrees. This last bend is a matter of choice.

In the single object supporting shape for the retaining clip, not shown, the second bend does not occur, and the object is supported directly below support plate 284. It is in the one object supporting shape that support plate 284 acts to protect the object and prevent the materials of processing to drip on the object being processed.

At the ends of wire 290 in any shape or configuration of retaining clip 285, wire 290 is configured to retain an object or objects to be processed. End configurations 294 and 296 are typical. Other object retaining configurations have been described above.

A further refinement is the provision of paired notches 300 (FIGS. 4 and 8) in support plate. Paired notches 300 enable specific spacing of retaining clips 285. Of course, retaining clip 285 must be correspondingly modified to account for the shorter distance between the edges of support plate 284 caused by pair notches 300. The improved spacing is clearly evident on utility cross support rod 210 of FIG. 4.

To further understand the benefits of retaining clip 285, the method of installation and removal is described. To install retaining clip 285 on utility cross support rod 210, reference is made to FIG. 8. Wire 290 is grasped between angular shape 288 and object retaining shape 294 with the thumb placed on the wire between angular shapes 288 and 286. Angular shape 288 is hooked into paired notch 300 and by levering wire 290 over the top of support plate 284, angular shape 286 is snapped into paired notch 300. Removal is even simpler. The wire 290 is grasped as before and angular shape 288 is merely levered off the paired notch 300. The method of installation and removal shows that the retaining clips may be spaced as closely as desired along the utility cross support rod closer spacing than that provided by other racks known in the art.

It will be apparent from the above description that this invention provides for an improved method for constructing electroplating and painting racks. One improved rack or fixture provides for a socket connection for easy assembly and disassembly of the rack and ease of alteration to meet specific processing need. Further, it is apparent from the above description that a utility cross support bar having a support plate and removeable retaining clips configured to the support plate provides for closer spacing of parts to be processed. This because the retaining clips are installed and removed only in a plane perpendicular to the utility cross support rod.

It will be appreciated that numerous changes and modifications may be made in the above described embodiments of the invention without departing from the scope thereof. Accordingly, the foregoing description is to be construed in an illustrative and not in a limitative sense, the scope of the invention being defined solely by the appended claims.

Having thus described the invention, what is claimed is:

1. A support rack for use in holding objects comprising:

a first primary support rod having a length and two ends;

a second primary support rod having a length substantially equal to the length of said first primary support rod, spaced apart and parallel to said first primary support rod;

at least one cross support rod having a length, two ends and a diameter, having means for releasable connection to said first and second primary support rods at the ends of said cross support rod;

a plurality of tip holding members each fixedly attached to said cross support rod, each tip holding member having a diameter and being configured to hold at least one releasably attached retaining tip, said objects being retained by said retaining tip;

wherein said means for releasable connection between said cross support rod and said first and second primary support rods comprises:

a cross support rod socket fixedly attached to and parallel to the length of said primary support rod, said socket being configured to the diameter of said cross support rod;

a 90 degree bend in an end of said cross support rod.

2. A support rack according to claim 1 wherein said cross support rod further comprises:

a support plate having two parallel spaced apart side edges, a thickness and a length, said support plate being disposed lengthwise upon said cross support rod and being fixedly attached thereto;

at least one retaining clip made of spring material having a length and further having a portion of said length configured, by means of two angular shapes spaced apart along the length of said retaining clip by at least the width of said support plate, said angular shapes further being specifically spaced apart by a distance substantially equal to the width of said support plate, to simultaneously and releasably engage the two parallel spaced apart side edges of said support plate, said retaining clip having at least one end configured to hold at least one of said objects.

3. A support rack for use in holding objects comprising:

a first primary support rod having a length and two ends;

a second primary support rod having a length substantially equal to the length of said first primary support rod, spaced apart and parallel to said first primary support rod;

at least one cross support rod having a length, two ends and a diameter, and having means for releasable connection to said and second primary support rods at the ends of said cross support rod;

a plurality of tip holding members each fixedly attached to said cross support rod, each tip holding member having a diameter and being configured to hold at least one releasably attached retaining tip, said objects being retained by said retaining tip;

wherein said means for releasable connection between said cross support rod and said first and second primary support rods comprises:

a cross support rod socket fixedly attached to and parallel to the length of said primary support rod, said socket being configured to the diameter of said cross support rod;

a hanger releasably attached to one end of said first and second primary support rods respectively, said hanger comprising a hook member and two arm members each having a length pivotably connected at one end of each by a pivotal connection means;

said hook member bearing a 180 degree bend at one end for use in supporting the assembled support rack, the other end of said hook member being configured to said pivotal connection means;

each of said arm members bearing at one end means for releasable connection to hanger support sockets fixedly attached to one end of said first and second primary support rods respectively, the other end of each of said arm members being configured to said pivotal connection means.

4. A support rack for use in holding objects comprising:

a first primary support rod having a length and two ends;

a second primary support rod having a length substantially equal to the length of said first primary support rod, spaced apart and parallel to said first primary support rod;

at least one cross support rod having a length, two ends and a diameter, and having means for releasable connection to said first and second primary support rods at the ends of said cross support rod;

a support plate having two parallel spaced apart side edges, a thickness and a length, said support plate being disposed lengthwise upon said cross support rod and being fixedly attached thereto;

at least one retaining clip made of spring material having a length and further having a portion of said length configured, by means of two angular shapes spaced apart along the length of said retaining clip by at least the width of said support plate, said angular shapes further being spatially spaced apart by a distance substantially equal to the width of said support plate, to simultaneously and releasably engage the two parallel spaced apart side edges of said support plate, said retaining clip having at least one end configured to hold at least one of said objects.

5. A support rack according to claim 4 wherein said support plate is an angle member wherein said two parallel spaced apart side edges remain parallel and spaced apart by a distance less than the width of said plate, the angle being lengthwise and the width being the sum of the two legs of the angle.

6. A support rack according to claim 5 wherein said retaining clip is further configured such that the space between its angular shapes is configured to simultaneously and releasably engage the two parallel spaced apart side edges of said angle support plate and the apex of the angle in said support plate.

7. A support rack according to claim 4 or 6 wherein the two parallel spaced apart edges of said support plate bear notch pairs corresponding to one another and in the same plane passing across the width of said support plate, said notches configured to releasably engage said spatially spaced apart angular shapes, said distance of spatial spacing being reduced by the combined depth of a notch pair.

8. A method for making a rack for use in electroplating objects, comprising the steps of:

providing a central support rod of electrically conductive material having a length and an effective diameter; disposing on one end of said central support rod means for connection to a D.C. power source;

disposing along the length of said central support rod at least one retaining tip spaced apart from said means for electrical connection, said retaining tip being made of an electrically conductive spring material having two arm members one joined to the other at one end by a circular wound helical spring, the inside rest diameter of the circular wound helical spring being less than the effective diameter of said central support rod, the other end of said arm members bearing support means configured to hold at least one of said objects, said central support rod being disposed within the circular wound helical spring of said retaining tip and being in frictional contact therewith sufficient to prevent said retaining tip from moving relative to said central support rod prior to mounting said objects on said arm member support means, said retaining tips being disposed about said central support rod by moving said arms apart angularly about said helical winding to expand open the inside diameter of said winding sufficient to allow insertion of said central support rod, when said retaining tip with inside diameter expanded open is located properly along the length of said rod, said arms are released thereby closing said helical winding tightly about said rod, said arms being then angularly displaced relative to their rest positions, said helical spring winding being maintained at a larger inside diameter than said inside rest diameter by the surface of said central support rod, thereby forming an electrical connection between said retaining tip and said central support rod;

the steps of providing a covering which forms a continuous layer over the surface of said support rod and retaining tip combination, said covering being made of a material which is impervious to the electroplating solution, said material being then removed from portions of said rack in which electrical connection is required and at the object retaining ends of said retaining tips;

the step of disposing a releasably lockable wire around said coating at a location on said central support rod adjacent said means for connection to a D.C. power source to prevent loss of the electroplating solution by its being drawn between said central support rod and said coating.

9. The method according to claim 8 further comprising the step of providing said covering material as a plastic selected from the group consisting of a polyvinyl chloride compound, vinyl and polyethylene.

* * * * *